US005875727A

United States Patent [19]

Elson et al.

[11] Patent Number: 5,875,727

[45] Date of Patent: Mar. 2, 1999

[54] LIFT FOR A PERSONAL WATERCRAFT

[75] Inventors: Todd A. Elson, Claremore; Monte D. Vogt, Owasso, both of Okla.

[73] Assignee: Hydrohist International, Inc., Claremore, Okla.

[21] Appl. No.: 899,216

[22] Filed: Jul. 23, 1997

[51] Int. Cl.[6] ..... B63B 35/40

[52] U.S. Cl. ..... 114/259; 114/263

[58] Field of Search ..... 114/258, 259, 114/263, 77 R, 344, 248

[56] References Cited

U.S. PATENT DOCUMENTS

| | | | |
|---|---|---|---|
| 3,224,019 | 12/1965 | Gudmundson | 114/344 |
| 3,339,217 | 9/1967 | Gudmundson | 114/344 |
| 3,360,809 | 1/1968 | Gudmundson | 114/344 |
| 3,365,733 | 1/1968 | Gudmundson | 114/344 |

OTHER PUBLICATIONS

EZ Dock Brochure; 1731B Mobile Drive; Winona, Minnesota 55987.

Jet Dock Brochure; 4620 Hinckley Industrial Parkway, Cleveland, Ohio 44109.

*Primary Examiner*—Sherman Basinger
*Attorney, Agent, or Firm*—Frank J. Catalano

[57] ABSTRACT

A lift for docking a personal watercraft from a body of water has a shell with a cradle for supporting the watercraft and an open end for horizontally receiving the watercraft. A buoyant filler within the shell floats it with its open end approximately aligned with the water surface. A replaceable skid plate substantially centered on the open end of the shell engages the tapered bow portion of the watercraft during the docking process and guides the watercraft into substantially a centered position on the shell and raises the watercraft upwardly and drives the shell downwardly as the watercraft is horizontally transferred onto the shell from the body of water. The shell has two pairs of posts, one pair extending forwardly from the front and one pair rearwardly from the back, one proximate each of the sides of the shell. Each post has a flange about its free end. A pair of flat, resiliently elastic members mounted in side-by-side position of adjacent shells assures maximum stability of the multiple lift arrangement. Each elastic member may have at least one distortion aperture so that forces exerted on connected shells will tend to deform the distortion apertures rather than the mounting apertures and reduce the possibility of a lift being separated from its multiple lift arrangement.

13 Claims, 5 Drawing Sheets

LIFT FOR A PERSONAL WATERCRAFT

BACKGROUND OF THE INVENTION

This invention relates generally to docking devices for recreational water vehicles and more particularly concerns lifts for personal watercraft.

Devices for docking personal watercraft in marinas and at private docks are well known. They are typically modular in configuration to facilitate multiple lift installations. Typically, one or more modules is moored to a dock by use of sections of PVC pipe extending vertically through holes in the front of the module so that the module is free to ride on the pipe as water level changes occur. Additional modules are then connected in various ways in side-to-side relationship to the moored modules. Alternatively, modules can be side moored to the dock with additional modules connected in side-to-side relationship extending away from the dock.

The known personal watercraft docking devices described above suffer from a variety of shortcomings. First of all, their side-to-side connection devices are relatively complex. For example, some known modules employ vertical jigsaw type slots along their perimeter with interlocking jigsaw pieces being inserted into the spaces defined by side-by-side modules so as to connect the modules together. Other known devices use a tongue and groove or overlapping type of arrangement, the modules being held together by pins extending through the overlapping portions of the modules. These configurations are cumbersome and expensive. Moreover, in single unit applications or for end-of-row modules in multiple unit applications, the sculpted contour of the lift perimeter reduces the usable walking area on the lift and results in an irregularly shaped pathway. Another problem with these devices is that they use removable jigsaw pieces or pin assemblies which must be stored elsewhere when the module is not connected in a multiple arrangement. A further shortcoming is that known personal watercraft docking devices, all of which receive the watercraft by impact of the watercraft bow with the device as it is driven from the body of water onto the lift, experience significant wear and damage at the point of impact during normal use. Eventually, replacement of the lift is required. Some lifts reduce this damage by providing a roller to absorb the impact before the watercraft makes contact with the main body of the lift. However, the roller is itself subject to damage and is either so short that it is easily missed entirely as the watercraft is driven onto the lift or so long that it provides no guiding function in directing the watercraft onto its desired position on the lift.

It is, therefore, an object of this invention to provide a modular personal watercraft lift which can be quickly connected into a multiple lift configuration. Another object of this invention is to provide a modular personal watercraft lift having a connection component which can be left permanently connected to its module. A further object of this invention is to provide a modular personal watercraft lift which reduces damage incurred by the main body of the watercraft during docking impact. Yet another object of this invention is to provide a modular personal watercraft lift having an impact receiving plate which may be easily removed from the watercraft and replaced without removal of the watercraft from service.

SUMMARY OF THE INVENTION

In accordance with the invention, a lift is provided for docking, supporting and launching a personal watercraft into, on and from a body of water. A shell with a cradle for supporting the watercraft has an open end for horizontally docking and launching the watercraft from and into the body of water. A buoyant filler within the shell floats the shell with its open end approximately aligned with the surface of the body of water. A skid plate is substantially centered on the open end of the shell to engage the tapered bow portion of the watercraft during the docking process. The skid is inwardly tapered toward its center so as to guide the watercraft into substantially a centered position on the shell and is upwardly tapered from its open end so as to raise the watercraft upwardly and drive the shell downwardly as the watercraft is horizontally transferred onto the shell from the body of water. Means is provided for detachably securing the skid plate to the shell. Preferably, the skid plate has the shape of an inverted, hollow semi-frustum with substantially vertical walls extending laterally outwardly from its sides and a top wall slanting rearwardly upwardly from its top, preferably with an arcuate junction therebetween. The open end of the shell main body is contoured to snugly abut the non-impact side of the skid plate. In one specially preferred embodiment, the shell has slots in its top and bottom portions forward of its open end and the securing means consists of resiliently flexible jaws with distal end portions firmly seated in the slots, the skid plate being integral with the jaws. For ease of connection in modular applications, the shell has sides orthogonal to its open end, a front parallel to its open end, a first pair of posts extending rearwardly from the open end, one proximate each of the sides of the shell, and a second pair of posts extending forwardly from the front, one proximate each of the sides of the shell. The posts are symmetrically located in relation to a vertical plane bisecting the shell and each post has a flange about its free end. A pair of flat, resiliently elastic members with a pair of mounting apertures of cross-section complimentary to the cross-section of the posts snugly receives the posts. The apertures are separated by a distance preferably equal to but at least twice the distance from the posts to the most proximate side of the shell. Exactly twice the distance is preferred so as to assure abutment of the sides of adjacent shells and thus provide maximum stability of the multiple lift arrangement. Preferably, the posts and mounting apertures are circular. Each elastic member may have at least one distortion aperture located between the mounting apertures but closer to a perimeter of the member than to its mounting apertures. Consequently, forces exerted on connected shells will tend to deform the distortion apertures rather than the mounting apertures and reduce the possibility of a lift being separated from the multiple lift arrangement. Most preferably, each member will have a pair of substantially triangular distortion apertures aligned on an axis transverse to an axis bisecting the mounting apertures and the member will be symmetrical about the bisecting axis and about the transverse axis.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
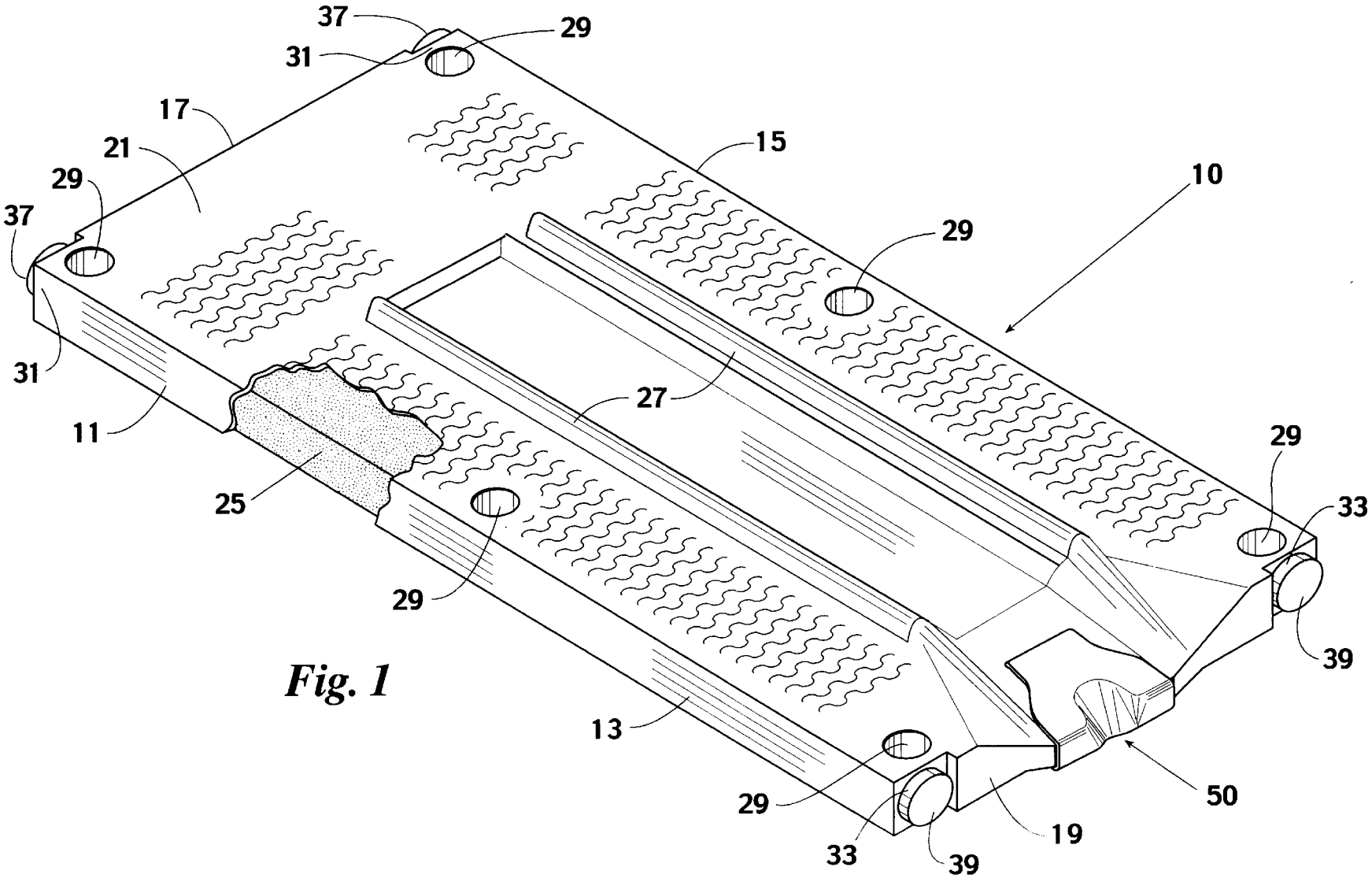
FIG. 1 is a perspective view illustrating a preferred embodiment of the personal watercraft lift.
Figure 2:
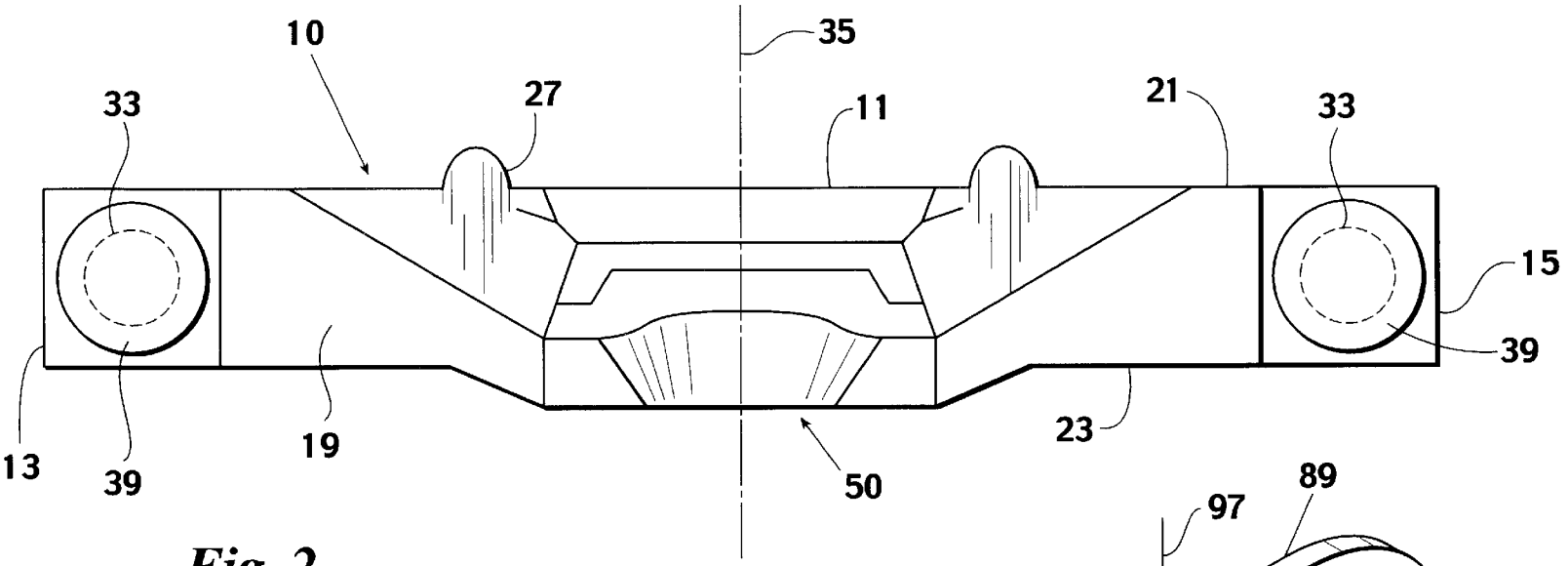
FIG. 2 is a rear elevation view of the personal watercraft lift of FIG. 1.

Turning first to FIGS. 1 and 2, a preferred embodiment of the lift 10 is illustrated. Preferably, the lift will include a polyethylene shell having walls approximately ⅛ to 3⁄16 inch thick. The shell 11 is preferably configured for modular applications in an orthogonal arrangement including sidewalls 13 and 15, a front wall 17, an open rear end 19, and top and bottom walls 21 and 23. While injection molded polyurethane is preferred, many other suitable materials are well known in the art. The shell 11 is preferably filled with a buoyant filler 25, such as styrofoam. The interior portion of the top wall 21 is contoured to define a cradle 27 suitable for supporting a watercraft in its operating orientation. The shell 11 is also provided with a plurality of mooring holes 29. The above described components of the lift 10 are generally well known in the art, though not necessarily configured in the specific manner shown in the drawings. However, the lift 10 of FIGS. 1 and 2 incorporate features not known in the prior art. First, the lift of FIG. 10 includes front and rear connecting posts 31 and 33 which are symmetrically displaced from a vertical plane 35 bisecting the shell 11 and which are equally displaced from the sidewalls 13 and 15 of the shell 11. Flanges 37 and 39 are provided on the front and rear posts 31 and 33 for reasons hereinafter explained. In addition, the lift 10 incorporates a skid plate 50 not known in the prior art.

Figure 3:
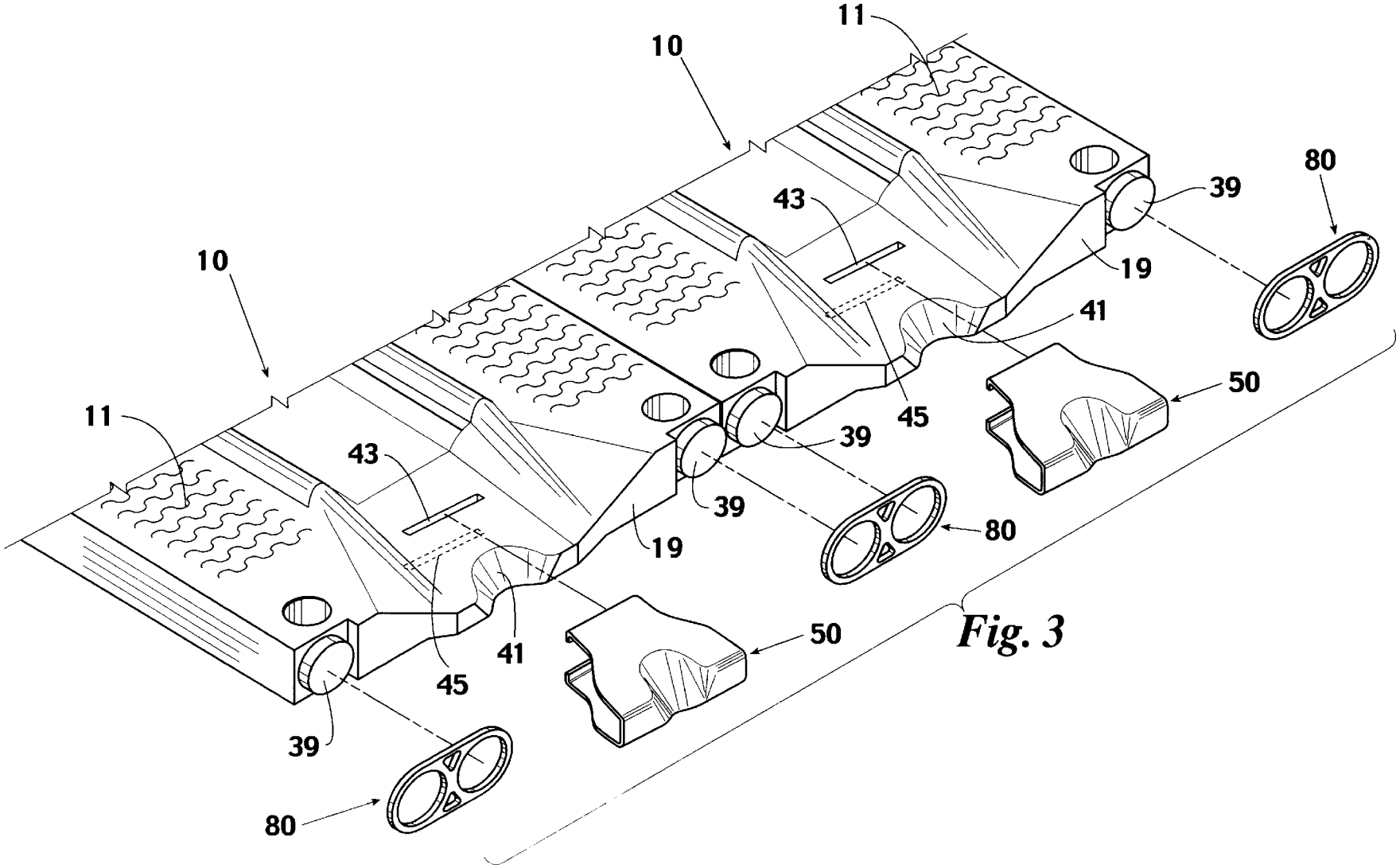
FIG. 3 is a perspective view of the rear portions of two personal watercraft lifts of FIG. 1 in side-by-side arrangement illustrating preferred embodiments of their connecting bands and replaceable skid plates.

Turning to FIG. 3, the lift 10 is shown in a multiple lift application taking advantage of the modular configuration of the lift 10. The rear portion of two lifts 10 are illustrated in side-by-side abutment. The rear or open end 19 of the shell 11 includes a docking guide 41 which is substantially centered on the open end 19 of the shell 11. Upper and lower slots 43 and 45 in the top and bottom walls 21 and 23 of the shell 11, respectively, are aligned with and forward of the docking guide 41. The contour of the docking guide 41 is such as to be snugly abutable with the interior surface of a skid plate 50. The side-by-side shells 11 are held in place by connecting bands 80, preferably of urethane, which are elastically resilient so as to stretch and snap over the flanges 37 or 39 on the front and rear posts 31 and 33, so as to securely grip the posts 31 or 33.

Figure 4:
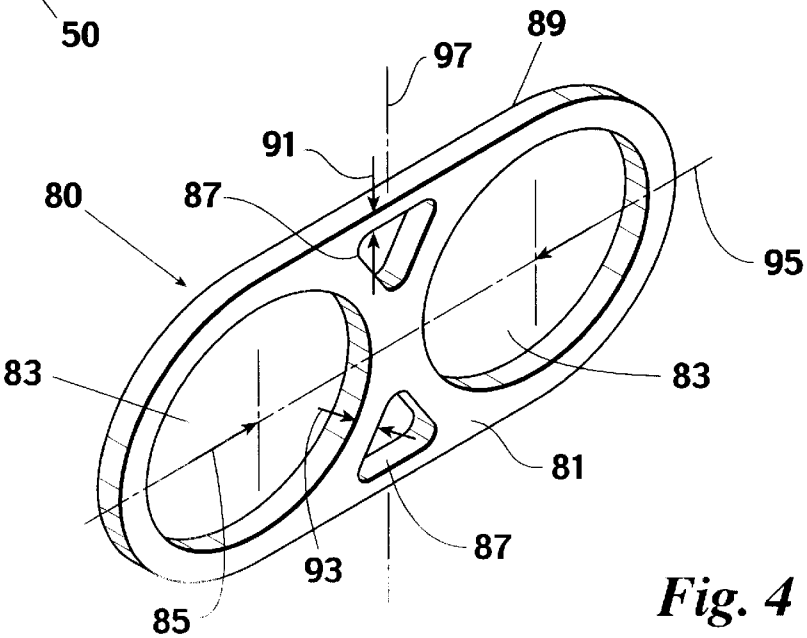
FIG. 4 is a perspective view illustrating the connecting bands of FIG. 3 in greater detail.

Turning to FIG. 4, the connecting bands 80 are flat, resiliently elastic members 81 having mounting apertures 83 separated from center to center by a distance 85 which is preferably equal to but at least twice the distance from a sidewall 13 or 15 of the shell 11 to the center of the nearest post 31 or 33. In the preferred embodiment, the posts 31 and 33 and flanges 37 and 39 are circular in cross-section and, therefore, the mounting apertures 83 in the connecting bands 80 are also circular. However, any desired configuration may be used for the posts 31 and 33 and flanges 37 and 39 with the bands 80 having their mounting apertures configured to complement the selected cross-section. Preferably, though not necessarily, the bands 80 are provided with one or more distortion apertures 87. Two substantially triangular distortion apertures 87 are shown. The distortion apertures 87 are disposed between the mounting apertures 83 but are closer to the perimeter 89 of the band 80 than to the mounting apertures 83. That is, the distance 91 from the perimeter 81 of the band 80 to the distortion aperture 87 is less than the distance 93 between the mounting aperture 83 and the distortion aperture 87. As a result, when multiple shells 11 are connected as shown in FIG. 3, if torque exerted on the interconnected modules would distort the elastic bands 80, distortion more readily occurs in the portion of the band 80 between a distortion aperture 87 and the band perimeter 89 than in the portion of the band 80 surrounding the mounting aperture 83. Consequently, it is less likely that external forces applied to side-by-side shells 11 will cause the bands 80 to become disengaged from their posts 31 or 33. It is preferred that the bands 80 be symmetrical about an axis 95 bisecting the mounting apertures 83 and also be symmetrical about an axis 97 transverse to the bisecting axis 95. As illustrated in FIG. 3, bands 80 not used to connect shells 11 together may be mounted and left on their posts 31 or 33 for subsequent use in connecting additional modules to the arrangement. While the connection of the rear portion of the shells 11 has been illustrated in FIG. 3, the connection of the front portions of the shells 11 is accomplished in identical fashion using identical bands 80.

Figure 5:
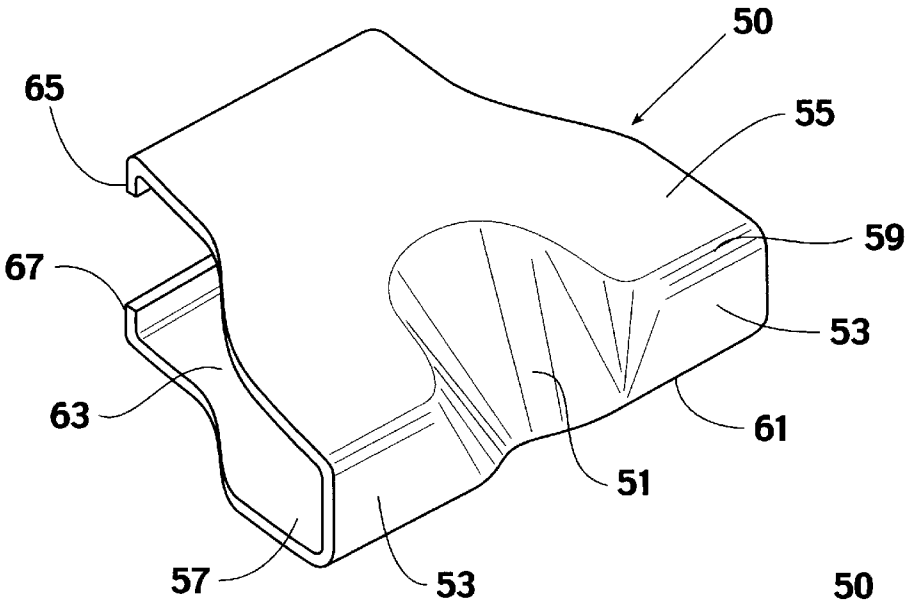
FIG. 5 is a perspective view illustrating the removable skid plate of FIG. 3 in greater detail.
Figure 6:
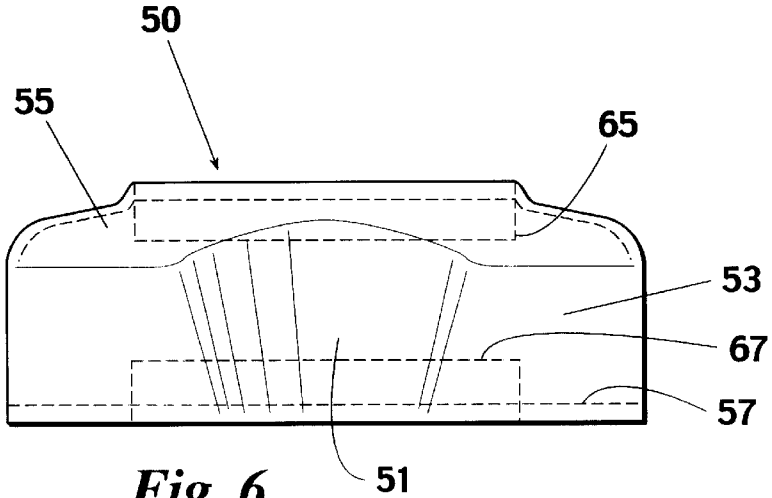
FIG. 6 is a rear elevation view of the removable skid plate of FIG. 5.
Figure 7:
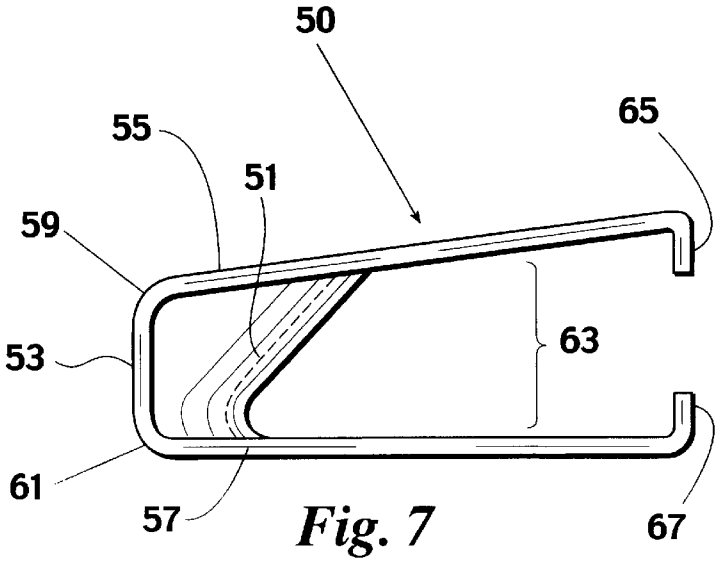
FIG. 7 is a side elevation view of the removable skid plate of FIG. 5.

Turning now to FIGS. 5, 6 and 7, a preferred embodiment of the skid plate 50 for use with the lift 10 is illustrated. The skid plate 50 consists of a member 51 which is inwardly tapered toward its center and rearwardly tapered from front to rear so as to provide a suitable surface for contacting the forwardly angled and rearwardly tapered bow of the watercraft. This results in a member 51 in the shape of an inverted hollow semi-frustum. The semi-frustum may be of a circular or other cone but, as shown, is preferably the semi-frustum of an elliptical cone. To broaden the target area of the skid plate 50 for impact with the watercraft and also to strengthen the skid plate 50, substantially vertical walls 53 extend laterally outwardly from the member 51. A top wall 55 slants rearwardly and upwardly from the top of the member 51 and the vertical walls 53 and a bottom wall 57 extends rearwardly from the bottom of the member 51 and the vertical walls 53. Also preferably, the top and bottom walls 55 and 57 are joined to the vertical walls 53 by arcuate junctions 59 and 61 so as not to present any sharp edges to the watercraft during docking. As shown, the preferred means for connecting the skid plate 50 to the shell 11 is an integral extension of the skid plate 50 to define jaws 63 having distal upper and lower ends 65 and 67, preferably in the shape of opposed flanges which may be seated in the upper and lower slots 43 and 45, respectively, in the shells 11, as is best seen in FIG. 3. Preferably, the skid plate 50 is made of polyethylene or the like, and is resiliently flexible so that the jaws 63 can be opened and the skid plate 50 slid over the open end 19 of the shell 11 until the interior portion of the skid plate 50 is substantially fully in abutment with the docking guide portion 41 of the shell 11. The distal ends 65 and 67 of the jaws 63 will then snap into the slots 43 and 45 of the shell 11 to lock the skid plate 50 in place on the shell 11. While this arrangement is preferred, it is also satisfactory to replace the slots 43 and 45 in the shell 11 with apertures extending entirely through the shell 11 and to provide similar apertures in the skid plate 50 so as to permit the use of one or more bolts to secure the skid plate 50 in place on the shell 11. Other methods of securing the skid plate 50 in place will be readily apparent to those skilled in the art. However, it is preferred that the securing means facilitates the rapid removal and replacement of the skid plate 50 from and on the shell 11.

Figure 8:
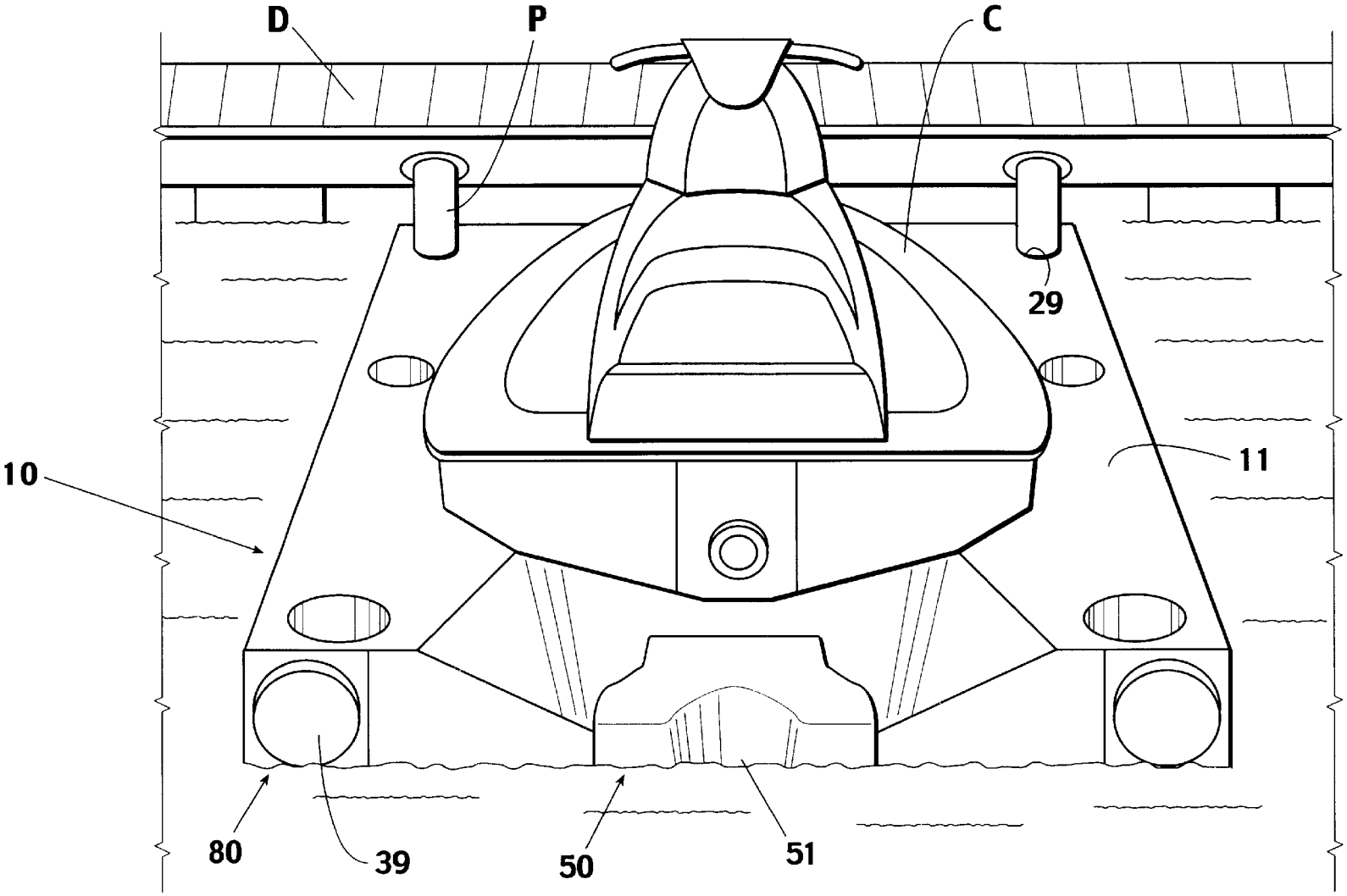
FIG. 8 is a perspective view illustrating a personal watercraft docked on the lift of FIG. 1.

Turning now to FIG. 8, a single lift 10 is mounted to a dock D by use of vertical pipes P which extend through two of the mooring holes 29 in the lift 10. As shown, the lift 10 is connected to the dock D by use of the two front mooring holes 29. However, connection could also be accomplished by using two of the side mooring holes 29. As shown, connecting bands 80 are mounted on the rear posts 33 for future connection to the rear posts 33 of another lift 10. Similarly, connecting bands 80 may also be mounted on the front posts 31 of the lift 10 for future connection to the front posts 31 of another lift 10. The personal watercraft C is shown oriented in its operable condition on the lift 10. To enable docking of the watercraft C in the position shown on the lift 10, the flotation of the shell 11 such that the water line of the rear open end 19 of the shell 10 is proximate the tapered member 51 of the skid plate 50. The member 51 may be positioned slightly above or below the water line, so long as the bow of the watercraft C is directed into the tapered member 51 as the watercraft C is driven onto the lift 10. The width of the member 51 is sufficient to provide an adequate target for the operator and the laterally extending vertical walls 53 help assure that direct contact will not be made with the shell 11 upon impact of the watercraft 10 with the shell 11. As the angled bow of the watercraft C impacts the tapered member 51 on the skid plate 50, the inward taper of the member 51 guides the watercraft C toward the center of the cradle 27 of the shell 11 while the upward taper of the member 51 causes the watercraft C to be lifted and the shell 11 to be downwardly driven to facilitate advancement of the watercraft C onto the lift 10.

It can be readily seen that the improvements of the present invention allow for the rapid connection of additional lifts 10 in a multi-lift configuration without the need for any components not already connected to the first lift. Furthermore, should a skid plate 50 be damaged, the skid plate 50 can readily be replaced without removal of the lift 11 from the dock D or from its connection to other lifts 10 and without the use of any tools whatsoever.

Thus, it is apparent that there has been provided, in accordance with the invention, an improved lift for a personal watercraft that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A lift for docking, supporting and launching a personal watercraft having a rearwardly tapered bow portion into, on and from, respectively, a body of water comprising:

a shell defining a cradle for supporting the watercraft thereon and having an open end for horizontally docking and launching the watercraft from and into the body of water and slots in top and bottom portions thereof forward of said open end;

a buoyant filler within said shell for floating said shell in the body of water with said open end approximately aligned with a surface of the body of water;

a skid plate, said plate being substantially centered on said open end of said shell for engaging the tapered bow portion of the watercraft, being inwardly tapered toward a center thereof for guiding the watercraft into substantially a centered position on the shell and being upwardly tapered from said open end of said shell for raising the watercraft upwardly and driving the shell downwardly as the watercraft is horizontally directed onto said shell from the body of water; and resilient jaws integral with said skid plate and having distal end portions firmly seated in said slots for detachably securing said skid plate to said shell in said substantially centered position on said open end of said shell.

2. A lift according to claim 1, said skid plate comprising an inverted, hollow semi-frustum.

3. A lift according to claim 1, said skid plate having substantially vertical walls extending laterally outwardly therefrom.

4. A lift according to claim 1, said skid plate having a top wall rearwardly upwardly slanting from a top thereof.

5. A lift according to claim 1, said skid plate having substantially vertical walls extending laterally outwardly therefrom and having a top wall rearwardly upwardly slanting from a top thereof, said vertical and top walls having an arcuate junction therebetween.

6. A lift according to claim 1, said open end of said shell having a contour snugly abutting said skid plate.

7. A lift for docking, supporting and launching a personal watercraft having a rearwardly tapered bow portion into, on and from, respectively, a body of water comprising:

a shell defining a cradle for supporting the watercraft thereon and having an open end for horizontally docking and launching the watercraft from and into the body of water;

a buoyant filler within said shell for floating said shell in the body of water with said open end approximately aligned with a surface of the body of water;

a skid plate, said plate being substantially centered on said open end of said shell for engaging the tapered bow portion of the watercraft, being inwardly tapered toward a center thereof for guiding the watercraft into substantially a centered position on the shell and being upwardly tapered from said open end of said shell for raising the watercraft upwardly and driving the shell downwardly as the watercraft is horizontally directed onto said shell from the body of water; and means for detachably securing said skid plate to said shell in said substantially centered position on said open end of said shell, said shell having sides orthogonal to said open end, a front parallel to said open end, a first pair of posts extending rearwardly from said open end thereof, one proximate each of said sides of said shell and a second pair of posts extending forwardly from said front thereof, one proximate each of said sides of said shell, said posts being symmetrically located in relation to a vertical plane bisecting said shell, each said post having a flange about a free end thereof.

8. A lift according to claim 7 further comprising a pair of flat resiliently elastic members having a pair of mounting apertures therethrough of cross-section complimentary to a cross-section of said posts for snugly receiving said posts therein and separated by a distance equal to at least twice the distance from said posts to a most proximate side of said shell.

9. A lift according to claim 8, said posts and said mounting apertures being circular.

10. A lift according to claim 8, each said member having at least one distortion aperture therethrough between said mounting apertures and closer to a perimeter of said member than to said mounting apertures.

11. A lift according to claim 10 each said member having a pair of substantially triangular distortion apertures aligned on an axis transverse to an axis bisecting said mounting apertures.

12. A lift according to claim 11, said member being symmetrical about said bisecting axis.

13. A lift according to claim 11, said member being symmetrical about said transverse axis.

* * * * *